US007448440B2

(12) United States Patent
Ichiyanagi et al.

(10) Patent No.: US 7,448,440 B2
(45) Date of Patent: Nov. 11, 2008

(54) HEAT EXCHANGER

(75) Inventors: Shigeharu Ichiyanagi, Oyama (JP); Koichiro Take, Oyama (JP)

(73) Assignee: Showa Denko K.K., Tokyo (JP)

( * ) Notice: Subject to any disclaimer, the term of this patent is extended or adjusted under 35 U.S.C. 154(b) by 119 days.

(21) Appl. No.: 11/566,311

(22) Filed: Dec. 4, 2006

(65) Prior Publication Data

US 2007/0131398 A1 Jun. 14, 2007

(30) Foreign Application Priority Data

Dec. 14, 2005 (JP) ..... 2005-360404

(51) Int. Cl.
*F28F 9/02* (2006.01)
*F28D 7/06* (2006.01)
*F28D 1/02* (2006.01)

(52) U.S. Cl. ..... 165/174; 165/176

(58) Field of Classification Search ..... 165/173, 165/174, 175, 176, 153, 158, 110
See application file for complete search history.

(56) References Cited

U.S. PATENT DOCUMENTS 5,242,016 A * 9/1993 Voss et al. ..... 165/174
5,934,367 A * 8/1999 Shimmura et al. ..... 165/174
6,595,273 B2 * 7/2003 Shimoya ..... 165/152
6,827,139 B2 * 12/2004 Kawakubo et al. ..... 165/173
2005/0217838 A1 * 10/2005 Katoh et al. ..... 165/176
2006/0137870 A1 * 6/2006 Ohhashi et al. ..... 165/174
2007/0044949 A1 * 3/2007 Ohashi ..... 165/176
2007/0051504 A1 * 3/2007 Ohashi ..... 165/176
2007/0131391 A1 * 6/2007 Ichiyanagi ..... 165/110

FOREIGN PATENT DOCUMENTS

JP 2005-326135 11/2005

OTHER PUBLICATIONS

U.S. Appl. No. 10/588,774, filed Aug. 8, 2006, Ichiyanagi, et al.
U.S. Appl. No. 10/588,209, filed Aug. 2, 2006, Ichiyanagi.
U.S. Appl. No. 11/578,552, filed Oct. 16, 2006, Ichiyanagi.
U.S. Appl. No. 11/564,038, filed Nov. 28, 2006, Ichiyanagi, et al.
U.S. Appl. No. 11/566,311, filed Dec. 4, 2006, Ichiyanagi, et al.

* cited by examiner

*Primary Examiner*—Tho V Duong
(74) *Attorney, Agent, or Firm*—Oblon, Spivak, McClelland, Maier & Neustadt, P.C.

(57) ABSTRACT

An upper header tank of an evaporator is formed by three plates. The outside plate has an inflow-side refrigerant-passage outwardly bulging portion whose one end portion communicates with a refrigerant inlet. The inside plate has tube insertion holes. The intermediate plate has communication holes for establishing communication between the tube insertion holes of the inside plate and the outwardly bulging portion of the outside plate. The communication holes of the intermediate plate are connected by communication portions so as to form a resin passage communicating with the outwardly bulging portion. Of all the communication portions of the refrigerant passage, a plurality of upstream communication portions are smaller in width than the remaining communication portions. The relation $0.25 \leqq A/B \leqq 0.35$ is satisfied, where A represents the number of the narrow communication portions, and B represents the total number of the communication holes which form the refrigerant passage.

5 Claims, 11 Drawing Sheets

HEAT EXCHANGER

BACKGROUND OF THE INVENTION

The present invention relates to a heat exchanger, and more particularly to a heat exchanger preferably used as an evaporator of a supercritical refrigeration cycle in which a supercritical refrigerant, such as $CO_2$ (carbon dioxide), is used.

Herein and in the appended claims, the term "supercritical refrigeration cycle" means a refrigeration cycle in which refrigerant on the high-pressure side is in a supercritical state; i.e., assumes a pressure in excess of a critical pressure. The term "supercritical refrigerant" means a refrigerant used in a supercritical refrigeration cycle. Further, herein and in the appended claims, the upper, lower, left-hand, and right-hand sides of FIGS. 1 and 2 will be referred to as "upper," "lower," "left," and "right," respectively; and the downstream side of flow (represented by arrow X in FIGS. 1 and 10) of air through air-passing clearances between adjacent heat exchange tubes will be referred to as the "front," and the opposite side as the "rear."

The present applicant has proposed a heat exchanger used for use in a supercritical refrigeration cycle (Japanese Patent Application Laid-Open (kokai) No. 2005-326135). The proposed heat exchanger includes upper and lower header tanks disposed apart from each other; and a plurality of heat exchange tubes disposed in parallel between the two header tanks and having opposite end portions connected to the respective header tanks. Each of the head tanks is configured such that an outside plate, an inside plate, and an intermediate plate intervening between the outside and inside plates are brazed together in layers. Each of the outside plates of the upper and lower header tanks has at least one an outwardly bulging portion extending in the longitudinal direction thereof and having an opening closed by the intermediate plate. The inside plate has a plurality of tube insertion holes in the form of through-holes formed in a region corresponding to the outwardly bulging portion of the outside plate and spaced apart from one another along the longitudinal direction thereof. The intermediate plate has a plurality of communication holes in the form of through-holes so as to allow the respective tube insertion holes of the inside plate to communicate with the interior of the outwardly bulging portion of the outside plate. Opposite end portions of the heat exchange tubes are inserted through the respective tube insertion holes of the inside plates of the two header tanks and are brazed to the inside plates. At least one outwardly bulging portion of each of the upper and lower header tanks serves a refrigerant-passage outwardly bulging portion within which refrigerant flows in the longitudinal direction. The communication holes of the intermediate plate communicating with the refrigerant-passage outwardly bulging portion are connected by means of communication portions each formed between adjacent communication holes of the intermediate plate. The communication holes communicating with the refrigerant-passage outwardly bulging portion and the communication portions connecting these communication holes cooperate to form a refrigerant passage which communicates with the interior of the refrigerant-passage outwardly bulging portion and causes the refrigerant to flow along the longitudinal direction of the refrigerant-passage outwardly bulging portion. The widths of the communication portions are adjusted so as to change the cross sectional area of the refrigerant passage along the longitudinal direction.

In the heat exchanger disposed in the publication, since the cross sectional area of the refrigerant passage, which communicates with the interior of the refrigerant-passage outwardly bulging portion and causes refrigerant to flow along the longitudinal direction of the refrigerant-passage outwardly bulging portion, is changed along the longitudinal direction, the quantity of refrigerant flowing through respective portions of the refrigerant passage can be changed arbitrarily. Therefore, the refrigerant flow amounts of all the heat exchange tubes can be properly set so as to increase the heat exchange performance. In addition, the distribution of refrigerant to each heat exchange tube can be adjusted in accordance with the velocity distribution of air passing through air-passing clearances between adjacent heat exchange tubes.

However, since the degree of drift of refrigerant at the time of distribution to each heat exchange tube changes depending on the size of the heat exchange core section of the heat exchanger, in particular, the number of the heat exchange tubes, the widths of the communication portions, which constitute the refrigerant passage, must be optimally set in accordance with the number of heat exchange tubes communicating with the interior of the refrigerant-passage outwardly bulging portion.

SUMMARY OF THE INVENTION

An object of the present invention is to solve the above problem and to provide a heat exchanger which has a structure identical with that of the heat exchanger disclosed in the publication and in which the refrigerant flow amounts of the heat exchange tubes are optimally set so as to improve the heat exchange performance, in accordance with the number of heat exchange tubes communicating with a refrigerant-passage outwardly bulging portion.

To fulfill the above object, the present invention comprises the following modes.

1) A heat exchanger comprising upper and lower header tanks disposed apart from each other, and a plurality of heat exchange tubes disposed in parallel between the two header tanks and having opposite end portions connected to the respective header tanks, wherein each of the head tanks is configured such that an outside plate, an inside plate, and an intermediate plate intervening between the outside and inside plates are brazed together in layers; each of the outside plates of the upper and lower header tanks has a plurality of outwardly bulging portions each extending in the left-right direction and having an opening closed by the intermediate plate; the inside plate has a plurality of tube insertion holes in the form of through-holes formed in a region corresponding to the outwardly bulging portions of the outside plate and spaced apart from one another along the left-right direction; the intermediate plate has a plurality of communication holes in the form of through-holes so as to allow the respective tube insertion holes of the inside plate to communicate with the interiors of the corresponding outwardly bulging portions of the outside plate; opposite end portions of the heat exchange tubes are inserted through the respective tube insertion holes of the inside plates of the two header tanks and are brazed to the inside plates; at least one outwardly bulging portion of each of the upper and lower header tanks serves a refrigerant-passage outwardly bulging portion within which refrigerant flows in the longitudinal direction; the refrigerant-passage outwardly bulging portion of the upper header tank serves as an inflow-side refrigerant-passage outwardly bulging portion whose one end portion communicates with a refrigerant inlet formed in the upper header tank; the communication holes of the intermediate plates communicating with the refrigerant-passage outwardly bulging portions of the upper and lower header tanks are connected by means of communication portions each formed between adjacent communication holes of the intermediate plates; and the communication holes communicating with the refrigerant-passage outwardly bulging portions and the communication portions connecting these communication holes cooperate to form refrigerant passages in the intermediate plates of the upper and lower header tanks, the passages communicating with the interiors of the corresponding refrigerant-passage outwardly bulging portions and causing the refrigerant to flow in the left-right direction, wherein of all the communication portions which form the refrigerant passage of the intermediate plate communicating with the inflow-side refrigerant-passage outwardly bulging portion of the upper header tank, a plurality of communication portions on the upstream side with respect to the flow direction of the refrigerant have a width, as measured in the front-rear direction, smaller than that of the remaining communication portions; and the relation $0.25 \leqq A/B \leqq 0.35$ is satisfied, where A represents the number of the narrow communication portions, and B represents the total number of the communication holes which form the refrigerant passage.

2) A heat exchanger according to par. 1), wherein the relation $0.6 \leqq WA/WB \leqq 0.8$ is satisfied, where WA represents the width, as measured in the front-rear direction, of the narrow communication portions of all the communication portions which form the refrigerant passage of the intermediate plate communicating with the inflow-side refrigerant-passage outwardly bulging portion of the upper header tank, and WB represents the width of the remaining wide communication portions, as measured in the front-rear direction.

3) A heat exchanger according to par. 2), wherein the width WB of the wide communication portions falls within the range of 5 to 9 mm.

4) A heat exchanger comprising upper and lower header tanks disposed apart from each other, and a plurality of heat exchange tubes disposed in parallel between the two header tanks and having opposite end portions connected to the respective header tanks, wherein each of the head tanks is configured such that an outside plate, an inside plate, and an intermediate plate intervening between the outside and inside plates are brazed together in layers; each of the outside plates of the upper and lower header tanks has a plurality of outwardly bulging portions each extending in the left-right direction and having an opening closed by the intermediate plate; the inside plate has a plurality of tube insertion holes in the form of through-holes formed in a region corresponding to the outwardly bulging portions of the outside plate and spaced apart from one another along the left-right direction; the intermediate plate has a plurality of communication holes in the form of through-holes so as to allow the respective tube insertion holes of the inside plate to communicate with the interiors of the corresponding outwardly bulging portions of the outside plate; opposite end portions of the heat exchange tubes are inserted through the respective tube insertion holes of the inside plates of the two header tanks and are brazed to the inside plates; at least one outwardly bulging portion of each of the upper and lower header tanks serves a refrigerant-passage outwardly bulging portion within which refrigerant flows in the longitudinal direction; the refrigerant-passage outwardly bulging portion of the upper header tank serves as an inflow-side refrigerant-passage outwardly bulging portion whose one end portion communicates with a refrigerant inlet formed in the upper header tank; the communication holes of the intermediate plates communicating with the refrigerant-passage outwardly bulging portions of the upper and lower header tanks are connected by means of communication portions each formed between adjacent communication holes of the intermediate plates; and the communication holes communicating with the refrigerant-passage outwardly bulging portions and the communication portions connecting these communication holes cooperate to form refrigerant passages in the intermediate plates of the upper and lower header tanks, the passages communicating with the interiors of the corresponding refrigerant-passage outwardly bulging portions and causing the refrigerant to flow in the left-right direction, wherein of all the communication portions which form the refrigerant passage of the intermediate plate communicating with the refrigerant-passage outwardly bulging portion of the lower header tank, a plurality of communication portions on the downstream side with respect to the flow direction of the refrigerant have a width, as measured in the front-rear direction, smaller than that of the remaining communication portions; and the relation $0.25 \leqq C/D \leqq 0.35$ is satisfied, where C represents the number of the narrow communication portions, and D represents the total number of the communication holes which form the refrigerant passage.

5) A heat exchanger according to par. 4), wherein the relation $0.6 \leqq WC/WD \leqq 0.8$ is satisfied, where WC represents the width, as measured in the front-rear direction, of the narrow communication portions of all the communication portions which form the refrigerant passage of the intermediate plate communicating with the refrigerant-passage outwardly bulging portion of the lower header tank, and WD represents the width of the remaining wide communication portions, as measured in the front-rear direction.

6) A heat exchanger according to par. 5), wherein the width WD of the wide communication portions falls within the range of 5 to 9 mm.

7) A heat exchanger according to par. 1) or 4), wherein the outside plate of the upper header tank has four outward bulging portions arranged apart from one another in the front-rear and left-right directions, and the outside plate of the lower header tank has two outward bulging portions arranged apart from each other in the front-rear direction such that each outward bulging portion faces corresponding two outward bulging portions of the upper header tank which are located adjacent to each other in the left-right direction;

a plurality of tube insertion holes are formed in each of front and rear portions of the inside plates of the two header tanks, and a plurality of communication holes are formed in each of front and rear portions of the intermediate plates of the two header tanks;

two pairs each including front and rear outwardly bulging portions are arranged on the upper header tank in the left-right direction, wherein the outwardly bulging portions of one of the pairs serve as the refrigerant-passage outwardly bulging portions, one of the two refrigerant-passage outwardly bulging portions serves as the inflow-side refrigerant-passage outwardly bulging portion, the other refrigerant-passage outwardly bulging portion serves as an outflow-side refrigerant-passage outwardly bulging portion whose one end communicates with a refrigerant outlet formed in the upper header tank, and the communication holes of the intermediate plate communicating with one of the two outwardly bulging portions of the other pair are connected to the communication holes of the intermediate plate communicating with the other outwardly bulging portion of the other pair by refrigerant-turning communication portions formed in the intermediate plate, whereby communication is established between the two outwardly bulging portions of the other pair; and the two outwardly bulging portions of the lower header tank each serves as a refrigerant-passage outwardly bulging portion.

According to the heat exchanger of par. 1), of all the communication portions which form the refrigerant passage of the intermediate plate communicating with the inflow-side refrigerant-passage outwardly bulging portion of the upper header tank, the plurality of communication portions on the upstream side with respect to the flow direction of refrigerant have a front-to-rear width smaller than that of the remaining communication portions. Therefore, even when refrigerant in the refrigerant passage of the intermediate plate communicating with the inflow-side refrigerant-passage outwardly bulging portion of the upper header tank tends to flow into the upstream side heat exchange tubes due to gravitational force, the amount of refrigerant flowing to the downstream side of the refrigerant passage can be increased. Accordingly, the refrigerant flow amounts of all the heat exchange tubes communicating with the refrigerant-passage outwardly bulging portion of the upper header tank can be set to optimal values for improving the heat exchange performance. In addition, the relation $0.25 \leqq A/B \leqq 0.35$ is satisfied, where A represents the number of the narrow communication portions, and B represents the total number of the communication holes which form the refrigerant passage. Since the total number B of the communication holes is naturally equal to the number of the heat exchange tubes communicating with the inflow-side refrigerant-passage outwardly bulging portion of the upper header tank, the refrigerant flow amounts of these heat exchange tubes can be set to optimal values for improving the heat exchange performance, in accordance with the number of the heat exchange tubes communicating with the interior of the inflow-side refrigerant-passage outwardly bulging portion. Further, the quantity of refrigerant delivered to each heat exchange tube can be adjusted in accordance with the velocity distribution of air passing through air-passing clearances between adjacent heat exchange tubes.

According to the heat exchanger of per. 2), the relation $0.6 \leqq WA/WB \leqq 0.8$ is satisfied, where WA represents the width, as measured in the front-rear direction, of the narrow communication portions of all the communication portions which form the refrigerant passage of the intermediate plate communicating with the inflow-side refrigerant-passage outwardly bulging portion of the upper header tank, and WB represents the width of the remaining wide communication portions, as measured in the front-rear direction. Therefore, the effect described in per. 1) above is achieved to a greater degree.

According to the heat exchanger of per. 3), since the width WB of the wide communication portions falls within the range of 5 to 9 mm, the effect described in per. 1) above is achieved to a greater degree.

According to the heat exchanger of per. 4), all the communication portions which form the refrigerant passage of the intermediate plate communicating with the refrigerant-passage outwardly bulging portion of the lower header tank, the plurality of communication portions on the downstream side with respect to the flow direction of refrigerant have a front-to-rear width smaller than that of the remaining communication portions. Therefore, even when refrigerant in the refrigerant passage of the intermediate plate communicating with the refrigerant-passage outwardly bulging portion of the lower header tank tends to flow to the downstream side due to inertial force, a local increase in refrigerant flow rate at the downstream side of the refrigerant passage can be prevented. Accordingly, the refrigerant flow amounts of all the heat exchange tubes communicating with the refrigerant-passage outwardly bulging portion of the lower header tank can be set to optimal values for improving the heat exchange performance. In addition, the relation $0.25 \leqq C/D \leqq 0.35$ is satisfied, where C represents the number of the narrow communication portions, and D represents the total number of the communication holes which form the refrigerant passage. Since the total number D of the communication holes is naturally equal to the number of the heat exchange tubes communicating with the refrigerant-passage outwardly bulging portion of the lower header tank, the refrigerant flow amounts of these heat exchange tubes can be set to optimal values for improving the heat exchange performance, in accordance with the number of the heat exchange tubes communicating with the interior of the refrigerant-passage outwardly bulging portion. Further, the quantity of refrigerant delivered to each heat exchange tube can be adjusted in accordance with the velocity distribution of air passing through air-passing clearances between adjacent heat exchange tubes.

According to the heat exchanger of par. 4), the relation $0.6 \leqq WC/WD \leqq 0.8$ is satisfied, where WC represents the width, as measured in the front-rear direction, of the narrow communication portions of all the communication portions which form the refrigerant passage of the intermediate plate communicating with the refrigerant-passage outwardly bulging portion of the lower header tank, and WD represents the width of the remaining wide communication portions, as measured in the front-rear direction. Therefore, the effect described in per. 4) above is achieved to a greater degree.

According to the heat exchanger of per. 6), since the width WD of the wide communication portions falls within the range of 5 to 9 mm, the effect described in per. 4) above is achieved to a greater degree.

DESCRIPTION OF THE PREFERRED EMBODIMENT

An embodiment of the present invention will next be described in detail with reference to the drawings. This embodiment is implemented by applying a heat exchanger according to the present invention to an evaporator for a supercritical refrigeration cycle.

Figure 1:
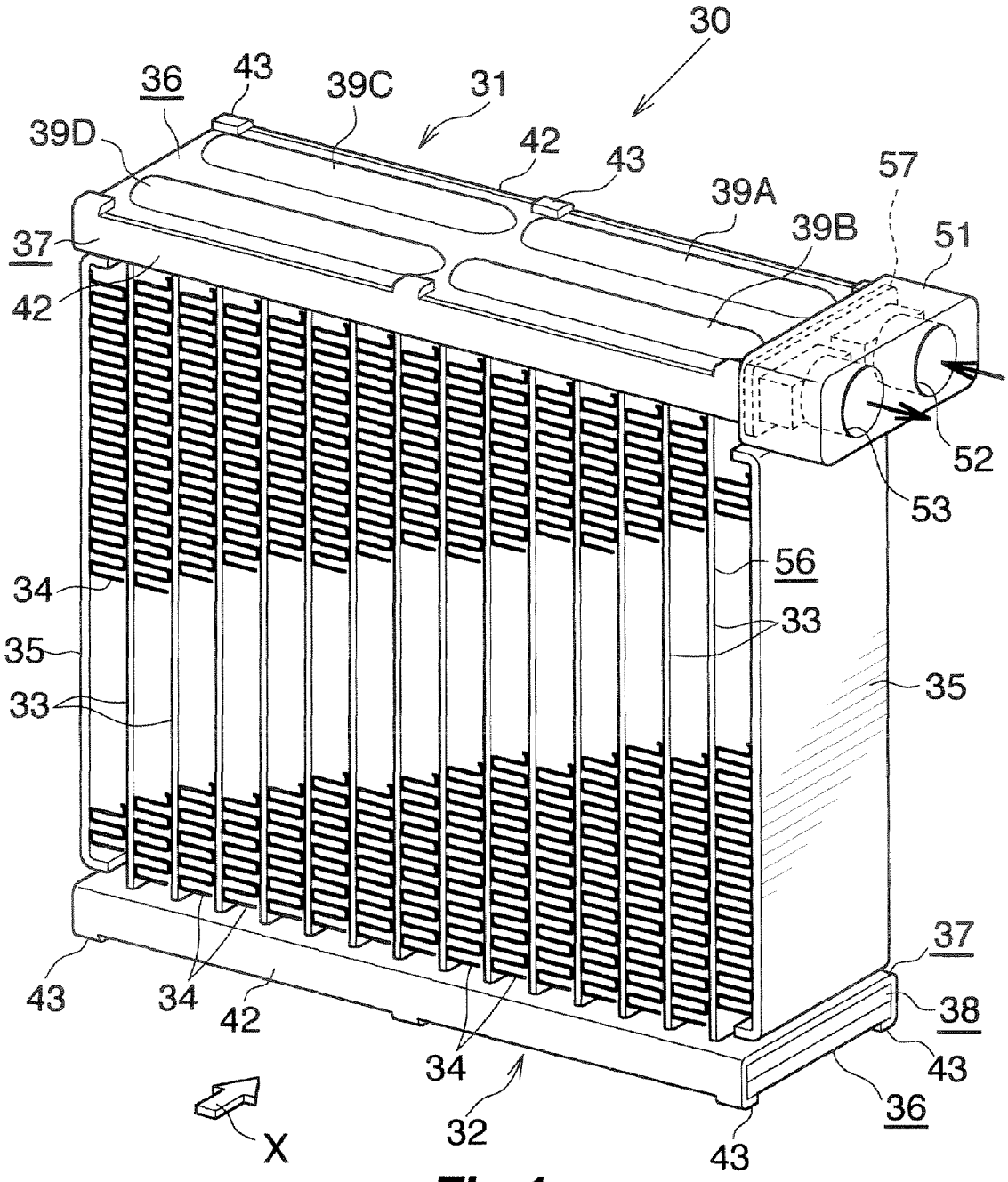
FIG. 1 is a perspective view showing the overall configuration of an evaporator to which a heat exchanger according to the present invention is applied.
Figure 2:
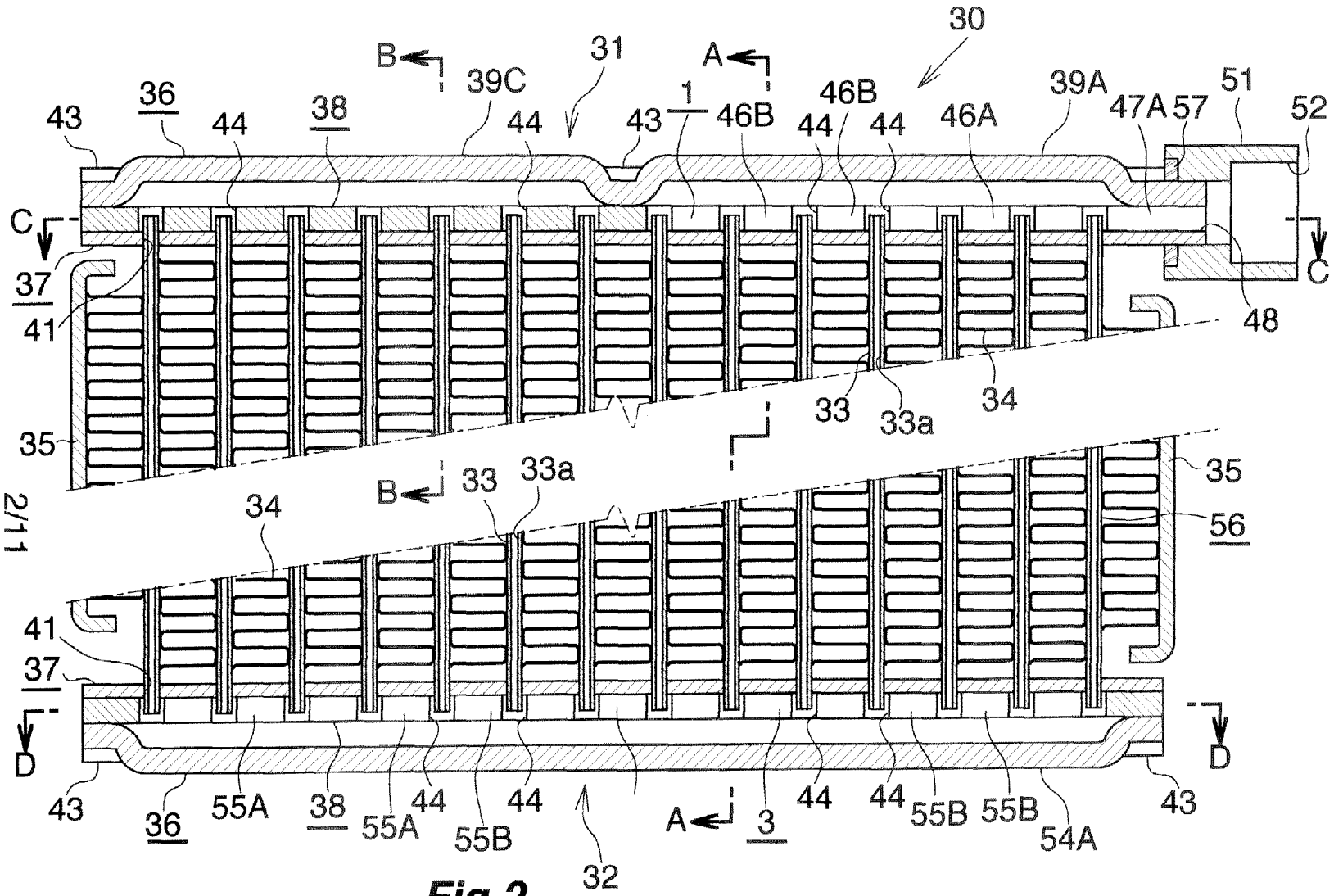
FIG. 2 is a fragmentary view in vertical section showing the evaporator of FIG. 1 as viewed from the rear frontward.
Figure 3:
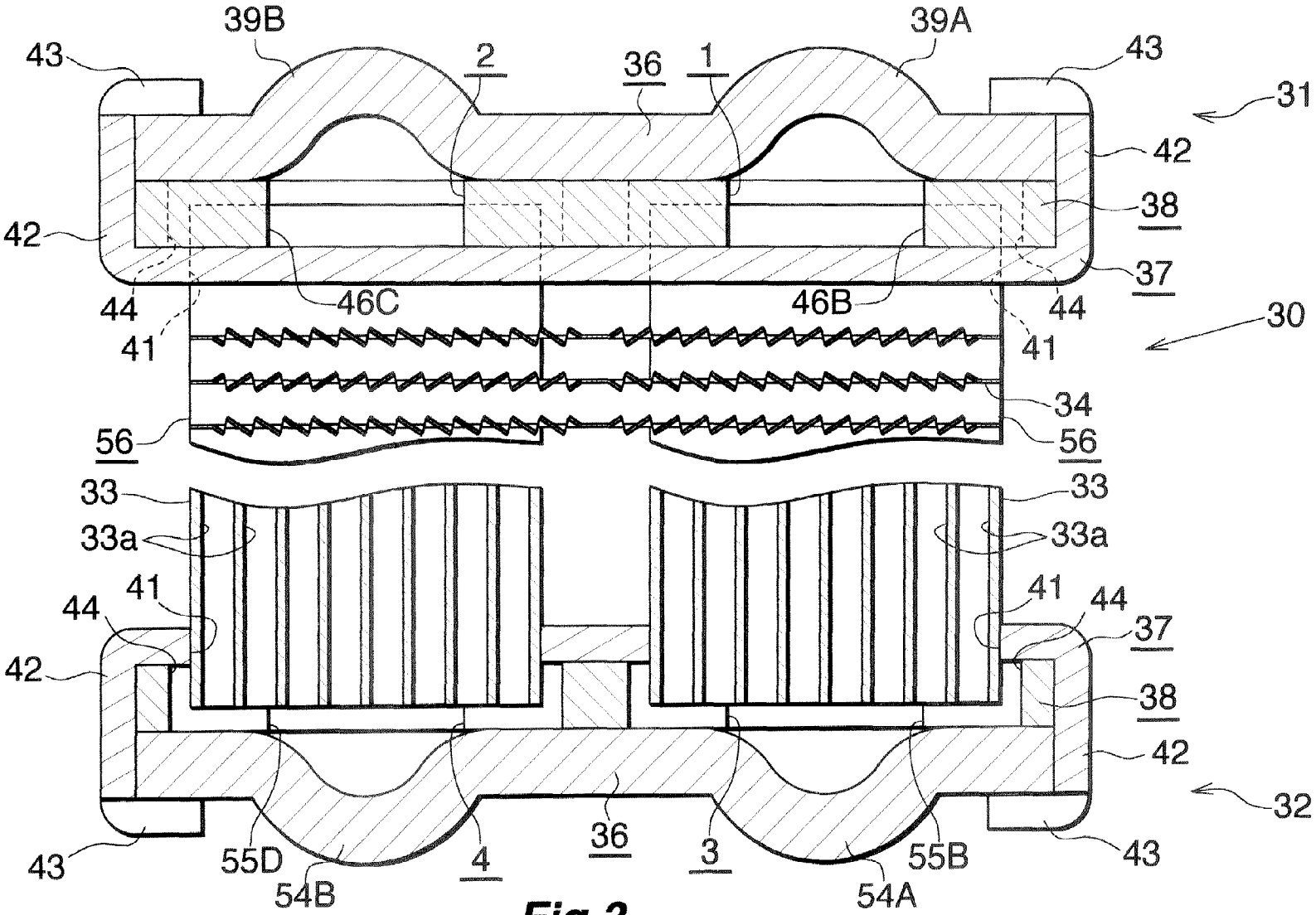
FIG. 3 is a fragmentary, sectional view taken along line A-A of FIG. 2.

FIGS. 1 to 3 show the overall configuration of the evaporator to which the present invention is applied. FIGS. 4 to 9 show essential portions of the evaporator of FIG. 1. FIG. 10 shows the flow of refrigerant in the evaporator of FIG. 1.

In the following description, the term "aluminum" encompasses aluminum alloys in addition to pure aluminum.

Referring to FIGS. 1 to 3, an evaporator 30 for use in supercritical refrigeration cycles wherein a supercritical refrigerant, such as $CO_2$, is used includes two header tanks 31 and 32 extending in the left-right direction and disposed apart from each other in the vertical direction; a plurality of flat heat exchange tubes 33 disposed between the header tanks 31 and 32 while being arranged in parallel and spaced apart from one another in the left-right direction; a plurality of corrugate fins 34 arranged in corresponding air-passing clearances between adjacent heat exchange tubes 33 and externally of the leftmost and rightmost heat exchange tubes 33 and each brazed to the adjacent heat exchange tubes 33 or to the leftmost or rightmost heat exchange tube 33; and side plates 35 of aluminum arranged externally of and brazed to the corresponding leftmost and rightmost corrugate fins 34. In the present embodiment, the upper header tank 31 will be referred to as a "first header thank," and the second header tank 32 will be referred to as a "second header thank."

The first header tank 31 includes an outside plate 36, an inside plate 37, and an intermediate plate 38. The outside plate 36 is made from a brazing sheet having a brazing material layer on each of opposite sides thereof; in the present embodiment, an aluminum brazing sheet. The inside plate 37 is made from a brazing sheet having a brazing material layer on each of opposite sides thereof; in the present embodiment, an aluminum brazing sheet. The intermediate plate 38 is made from a bare metal material; in the present embodiment, a bare aluminum material, and is interposed between the outside plate 36 and the inside plate 37. The outside plate 36, the inside plate 37, and the intermediate plate 38 are layered, and brazed together.

The outside plate 36 of the first header tank 31 has a right portion and a left portion which are provided with two outward bulging portions 39A and 39B and two outward bulging portions 39C and 39D, respectively. The outward bulging portions 39A to 39D extend in the left-right direction. The outward bulging portions 39A and 39C are spaced apart from the outward bulging portions 39B and 39D in the front-rear direction. In the present embodiment, the outward bulging portion 39A in the right front portion of the outside plate 36 will be referred to as the "first outward bulging portion," the outward bulging portion 39B in the right rear portion as the "second outward bulging portion," the outward bulging portion 39C in the left front portion as the "third outward bulging portion," and the outward bulging portion 39D in the left rear portion as the "fourth outward bulging portion." The outward bulging portions 39A to 39D have respective openings facing down and closed by the intermediate plate 38. The outward bulging portions 39A to 39D are equal in bulging height, length, and width. Therefore, a pair including the first outward bulging portion 39A and the second outward bulging portion 39B and a pair including the third outward bulging portion 39C and the fourth outward bulging portion 39D are arranged on the first header tank 31 in the left-right direction. The first and second outward bulging portions 39A and 39B of the first pair serve as refrigerant-passage outwardly bulging portions within which $CO_2$ flows in the longitudinal direction. The outside plate 36 is made by press work from an aluminum brazing sheet having a brazing material layer on each of opposite sides thereof.

Front and rear half portions of the inside plate 37 are each provided with a plurality of tube insertion holes 41 in the form of through-holes elongated in the front-rear direction and spaced apart from one another in the left-right direction. The tube insertion holes 41 in the front right half portion are formed within the left-to-right range of the first outward bulging portion 39A of the outside plate 36; the tube insertion holes 41 in the rear right half portion are formed within the left-to-right range of the second outward bulging portion 39B; the tube insertion holes 41 in the front left half portion are formed within the left-to-right range of the third outward bulging portion 39C; and the tube insertion holes 41 in the rear left half portion are formed within the left-to-right range of the fourth outward bulging portion 39D. The tube insertion holes 41 have a length slightly longer than the front-to-rear width of the outward bulging portions 39A to 39D, and have front and rear end portions projecting outward beyond the front and rear ends, respectively, of the corresponding outward bulging portions 39A to 39D (see FIGS. 3 and 4).

Cover walls 42 are integrally formed at the front and rear side edge portions of the inside plate 37. Each of the cover walls 42 projects upward such that its end reaches to the outer surface of the outside plate 36, and covers the boundary between the outside plate 36 and the intermediate plate 38 over the entire length. The cover walls 42 are brazed to the front and rear side surfaces of the outside plate 36 and the intermediate plate 38. A plurality of engaging portions 43 are formed integrally with the projecting end of each covering wall 42 while being spaced apart from one another in the left-right direction. The engaging portions 43 are engaged with the outer surface of the outside plate 36 and are brazed to the outside plate 36. The inside plate 37 is made by press work from an aluminum brazing sheet having a brazing material layer on each of opposite sides thereof.

The intermediate plate 38 has a plurality of communication holes 44 extending through the thickness thereof, located at positions corresponding to the tube insertion holes 41 of the inside plate 37, and equal in number to the tube insertion holes 41. The communication holes 44 allow the tube insertion holes 41 of the inside plate 37 to communicate with the interiors of the outward bulging portions 39A to 39D of the outside plate 36. The communication holes 44 are slightly larger than the tube insertion holes 41. The tube insertion holes 41 in the front right half portion of the inside plate 37 communicate with the interior of the first outward bulging portion 39A through the communication holes 44 in the front right half portion of the intermediate plate 38. The tube insertion holes 41 in the rear right half portion of the inside plate 37 communicate with the interior of the second outward bulging portion 39B through the communication holes 44 in the rear right half portion of the intermediate plate 38. The tube insertion holes 41 in the front left half portion of the inside plate 37 communicate with the interior of the third outward bulging portion 39C through the communication holes 44 in the front left half portion of the intermediate plate 38. The tube insertion holes 41 in the rear left half portion of the inside plate 37 communicate the interior of the fourth outward bulging portion 39D through the communication holes 44 in the rear left half portion of the intermediate plate 38.

Figure 4:
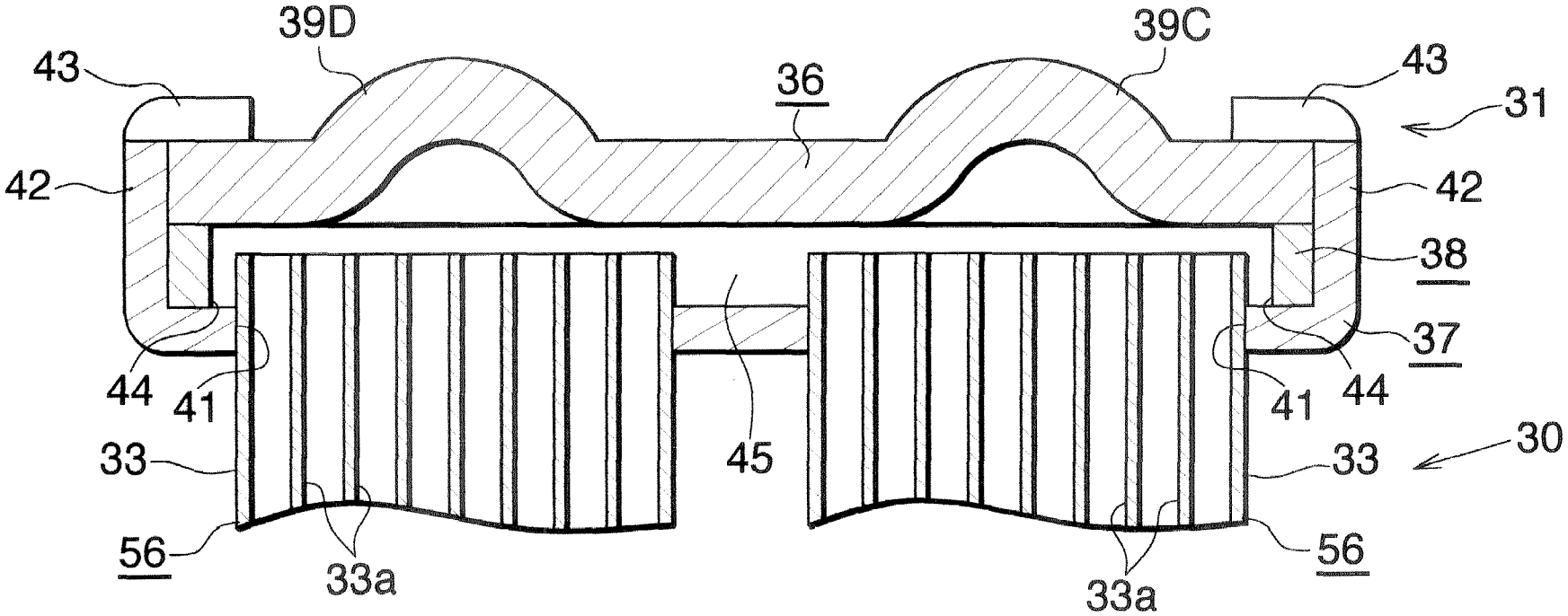
FIG. 4 is an enlarged fragmentary, sectional view taken along line B-B of FIG. 2.
Figure 5:
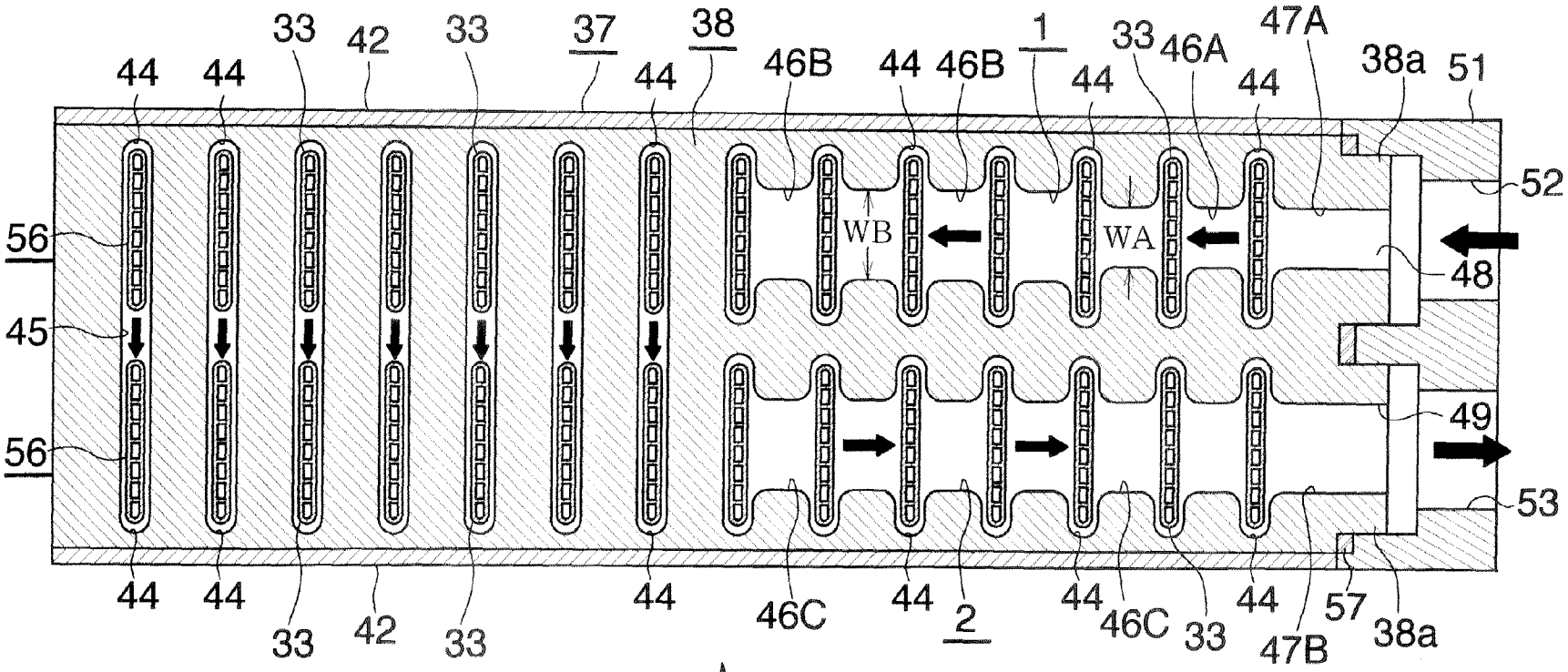
FIG. 5 is an enlarged sectional view taken along line C-C of FIG. 2.

As shown in FIGS. 4 and 5, the communication holes 44 of the intermediate plate 38 communicating with the third outward bulging portion 39C of the second pair of outward bulging portions of the first header tank 31 communicate with the corresponding communication holes 44 communicating with the fourth outward bulging portion 39D of the second pair via refrigerant-turning communication portions 45. The refrigerant-turning communication portions 45 are formed by cutting off portions between adjacent front and rear communication holes 44 of the intermediate plate 38. Thus, the interior of the third outward bulging portion 39C and the interior of the fourth outward bulging portion 39D communicate with each other. All the communication holes 44 communicating with the interior of the first outward bulging portion 39A, as well as all the communication holes 44 communicating with the interior of the second outward bulging portion 39B, communicate with one another through communication portions 46A, 46B, and 46C. The communication portions 46A, 46B, and 46C are formed by cutting off front-to-rear central portions between adjacent left and right communication holes 44 of the intermediate plate 38 (see FIG. 5). All the communication holes 44 communicating with the interior of the first outward bulging portion 39A and the communication portions 46A and 46*b* establishing communication among the communication holes 44 form, in the intermediate plate 38 of the first header tank 31, a first refrigerant passage 1 which communicates with the interior of the first outward bulging portion 39A and through which refrigerant flows in the left-right direction (the longitudinal direction of the first outward bulging portion 39A). Similarly, all the communication holes 44 communicating with the interior of the second outward bulging portion 39B and the communication portion 46C establishing communication among the communication holes 44 form, in the intermediate plate 38 of the first header tank 31, a second refrigerant passage 2 which communicates with the interior of the second outward bulging portion 39B and through which refrigerant flows in the left-right direction (the longitudinal direction of the second outward bulging portion 39B). The intermediate plate 38 is made from a bare aluminum material by press work.

Figure 6:
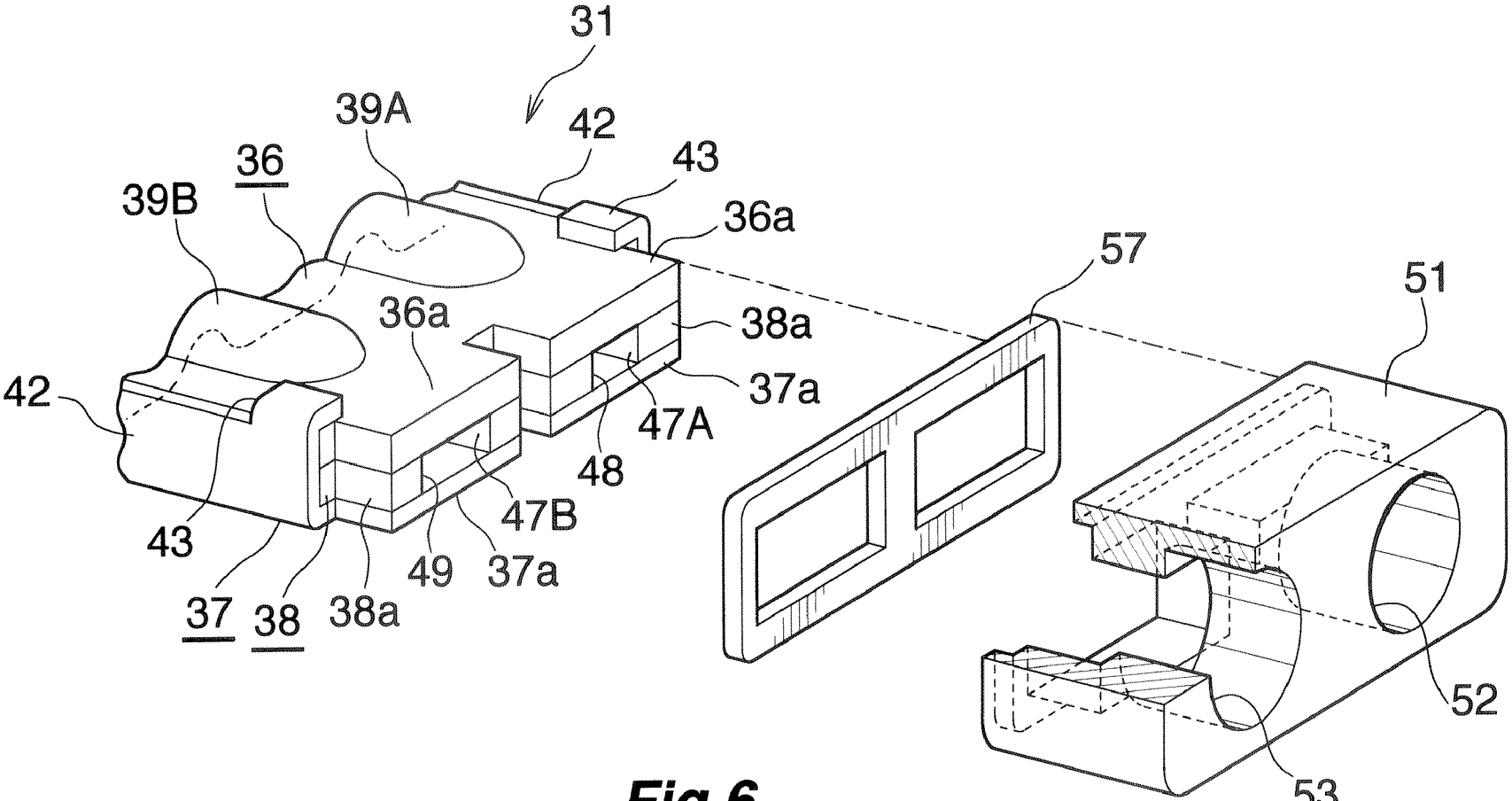
FIG. 6 is an exploded perspective view showing a right end portion of a first header tank of the evaporator of FIG. 1.
Figure 7:
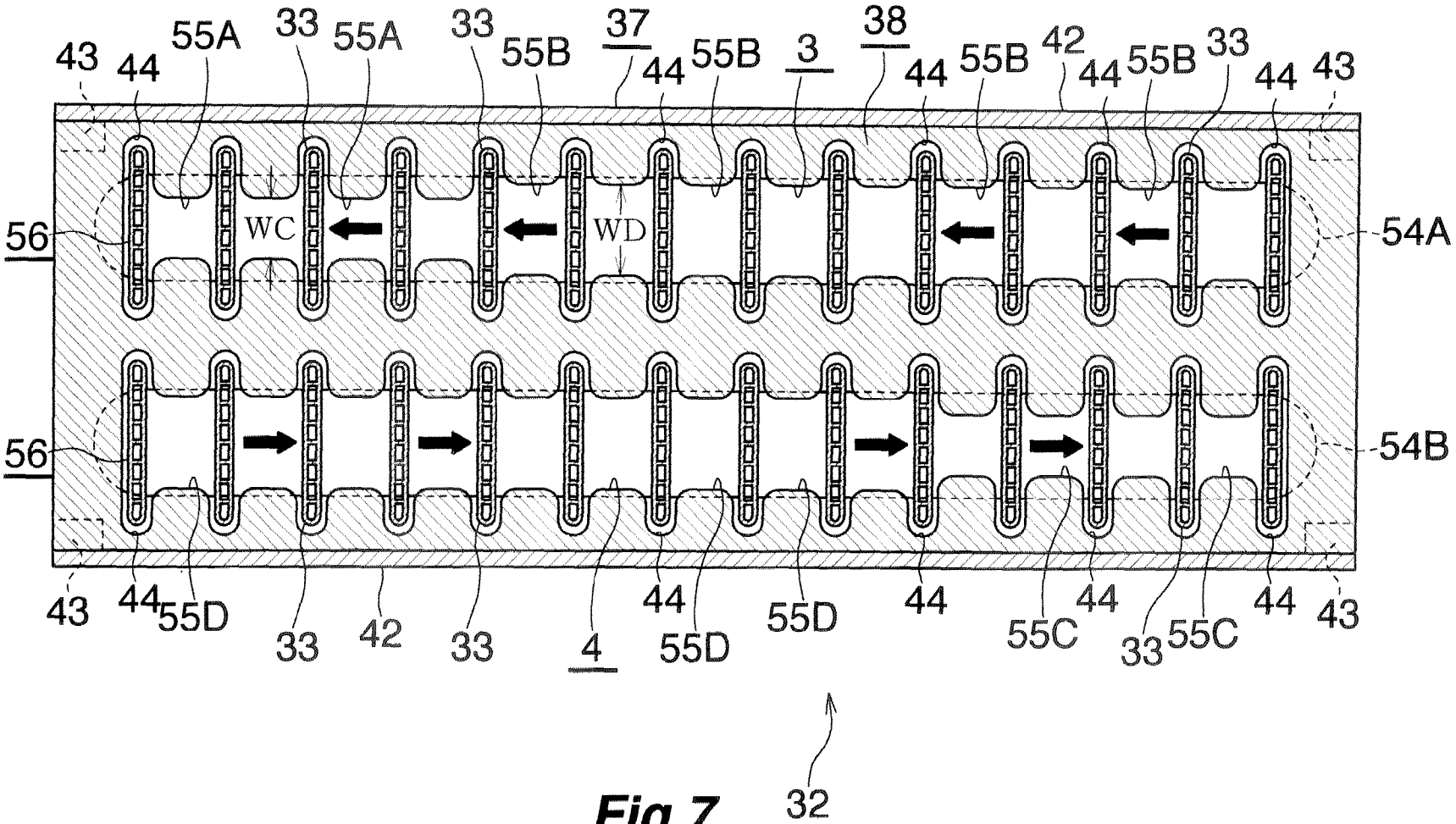
FIG. 7 is an enlarged sectional view taken along line D-D of FIG. 2.

As shown in FIGS. 5 and 6, the three plates 36, 37, and 38 are provided at the right ends thereof with two rightward projections 36*a*, 37*a*, and 38*a*, respectively, which are spaced apart in the front-rear direction. The intermediate plate 38 has cutouts 47A and 47B extending from the corresponding right ends of the front and rear rightward projections 38*a* to the corresponding rightmost communication holes 44. These cutouts 47A and 47B provide in the first header tank 31 a refrigerant inlet 48 communicating with the first refrigerant passage 1 and the interior of the first outward bulging portion 39A, and a refrigerant outlet 49 communicating with the second refrigerant passage 2 and the interior of the second outward bulging portion 39B. The first outward bulging portion 39A serves an inflow-side refrigerant-passage outwardly bulging portion one end of which communicates with the refrigerant inlet 48 formed in the first header tank 31. Notably, the front-to-rear width of the front-side cutout 47A is equal to the front-to-rear width of the right end communication portion 46A, which partially constitutes the first refrigerant passage 1. A refrigerant inlet-outlet member 51 is brazed to the first header tank 31 by use of a brazing sheet having a brazing material layer on each of opposite sides thereof; in the present embodiment, an aluminum brazing sheet 57, while being fitted to the two rightward projections 36*a*, 37*a*, and 38*a* of the three plates 36, 37, and 38, respectively. The refrigerant inlet-outlet member 51 has a refrigerant inflow channel 52 communicating with the refrigerant inlet 48, and a refrigerant outflow channel 53 communicating with the refrigerant outlet 49. The refrigerant inlet-outlet member 51 is formed from a bare metal material; in the present embodiment, a bare aluminum material.

Of all the communication portions 46A and 46B, which form the first refrigerant passage 1, the plurality of communication portions 46A on the upstream side with respect to the flow direction of refrigerant; i.e., on the right end side of the first refrigerant passage 1 have a width WA, as measured in the front-rear direction, smaller than the width WB of the remaining communication portions 46B. Here, when the number of the narrow communication portions 46A is represented by A, and the total number of the communication holes 44, which form the first refrigerant passage 1; i.e., the total number of the heat exchange tubes 33 communicating with the first outward bulging portion 39A, is represented by B, the relation $0.25 \leqq A/B \leqq 0.35$ must be satisfied. Further, preferably, the width WA of the narrow communication portions 46A and the width WB of the remaining wide communication portions 46B satisfy the relation $0.6 \leqq WA/WB \leqq 0.8$. Preferably, the width WB of the wide communication portions 46B is 5 to 9 mm.

The reason why the relation between the number A of the narrow communication portions 46A and the total number B of the communication holes 44, which form the first refrigerant passage 1; i.e., the total number of the heat exchange tubes 33 communicating with the first outward bulging portion 39A (the ratio of A to B) is limited to $0.25 \leqq A/B \leqq 0.35$ is that when the ratio A/B falls within the above-described range, the evaporator 30 has an excellent cooling performance.

The reason why the width WA of the narrow communication portions 46A and the width WB of the remaining wide communication portions 46B are preferably determined to satisfy the relation $0.6 \leqq WA/WB \leqq 0.8$ is that when $WA/WB < 0.6$, the passage resistance may increase, and when $WA/WB > 0.8$, the cooling performance may be deteriorated.

Further, when the width WB of the wide communication portions 46B is less than 5 mm, the passage resistance may increase, with a resultant increase in evaporation temperature and a drop in the cooling performance. When width WB of the wide communication portions 46B is larger than 9 mm, the area of contact between the inside plate 37 and the intermediate plate 38 decreases, with a resultant decrease in the withstanding pressure of the first header tank 31.

All the communication portions 46C of the second refrigerant passage 2 have the same width as measured in the front-rear direction; and the with is equal to the width WB of the wide communication portions 46B of the first refrigerant passage 1.

As shown in FIGS. 1 to 3 and FIG. 7, the second header tank 32 has a structure similar to that of the first header tank 31. Therefore, like members and portions are denoted by like reference numerals. The header tanks 31 and 32 are disposed such that their inside plates 37 face each other. The second header tank 32 differs from the first header tank 31 in the following points. The outside plate 36 has two outward bulging portions 54A and 54B extending from a right end portion thereof to a left end portion thereof and spaced apart in the front-rear direction such that the outward bulging portion 54A is opposed to both the first and third outward bulging portions 39A and 39C, and the outward bulging portion 54B is opposed to both the second and fourth bulging portions 39B and 39D. All the communication holes 44 communicating with the interior of the front outward bulging portion 54A, as well as all the communication holes 44 communicating with the interior of the rear outward bulging portion 54B, communicate with one another through communication portions 55A to 55D. The communication portions 55A to 55D are each formed by cutting off portions between adjacent left and right communication holes 44 in the intermediate plate 38. The communication holes 44 communicating with the interior of the front outward bulging portion 54A and the communication portions 55A and 55B establishing the communication among the communication holes 44 form a front refrigerant passage 3 in the intermediate plate 38. The communication holes 44 communicating with the interior of the rear outward bulging portion 54B and the communication portions 55C and 55D establishing the communication among the communication holes 44 form a rear refrigerant passage 4 in the intermediate plate 38. Communication is not established between the two outward bulging portion 54A and 54B. Rightward projections are not formed at the right end portions of the three plates 36, 37, and 38. The outward bulging portion 54A and 54B are equal in bulging height and width to the outward bulging portion 39A to 39D of the first header tank 31. The front and rear outward bulging portions 54A and 54B serve as refrigerant-passage outwardly bulging portions within which $CO_2$ flows in the longitudinal direction. Refrigerant flows from the right to the left within the front outward bulging portion 54A and the front refrigerant passage 3, and flows from the left to the right within the rear outward bulging portion 54B and the rear refrigerant passage 4.

Of all the communication portions 55A and 55B, which form the front refrigerant passage 3, the plurality of communication portions 55A on the downstream side with respect to the flow direction of refrigerant; i.e., on the left end side of the front refrigerant passage 3 have a width WC, as measured in the front-rear direction, smaller than the width WD of the remaining communication portions 55B. Here, when the number of the narrow communication portions 55A is represented by C, and the total number of the communication holes 44, which form the front refrigerant passage 3; i.e., the total number of the heat exchange tubes 33 communicating with the front outward bulging portion 54A, is represented by D, the relation $0.25 \leqq C/D \leqq 0.35$ must be satisfied. Further, preferably, the width WC of the narrow communication portions 55A and the width WD of the remaining wide communication portions 55B satisfy the relation $0.6 \leqq WC/WD \leqq 0.8$. Preferably, the width WD of the wide communication portions 55B is 5 to 9 mm.

The reason why the relation between the number C of the narrow communication portions 55A and the total number D of the communication holes 44, which form the front refrigerant passage 3; i.e., the total number of the heat exchange tubes 33 communicating with the front outward bulging portion 45A (the ratio of C to D) is limited to $0.25 \leqq C/D \leqq 0.35$ is that when the ratio C/D falls within the above-described range, the evaporator 30 has an excellent cooling performance.

The reason why the width WC of the narrow communication portions 55A and the width WD of the remaining wide communication portions 55B are preferably determined to satisfy the relation $0.6 \leqq WC/WD \leqq 0.8$ is that when $WC/WD < 0.6$, the passage resistance may increase, and when $WC/WD > 0.8$, the cooling performance may be deteriorated.

Further, when the width WD of the wide communication portions 55B is less than 5 mm, the passage resistance may increase, with a resultant increase in evaporation temperature and a drop in the cooling performance. When width WD of the wide communication portions 55B is larger than 9 mm, the area of contact between the inside plate 37 and the intermediate plate 38 decreases, with a resultant decrease in the withstanding pressure of the second header tank 32.

Of all the communication portions 55C and 55D, which form the rear refrigerant passage 4, the plurality of communication portions 55C on the downstream side with respect to the flow direction of refrigerant; i.e., on the right end side of the rear refrigerant passage 4 have a width as measured in the front-rear direction, smaller than the width of the remaining communication portions 55D. The front-to-rear width and number of the narrow communication portions 55C are equal to those of the narrow communication portions 55A of the front refrigerant passage 3, and the front-to-rear width of the wide communication portions 55D is equal to that of the wide communication portions 55B of the front refrigerant passage 3. Accordingly, the rear refrigerant passage 4 is identical to the front refrigerant passage 3 in terms of the relation between the number of the narrow communication portions 55C and the total number of the communication holes 44, which form the rear refrigerant passage 4; i.e., the total number of the heat exchange tubes 33 communicating with the rear outward bulging portion 54B, and the relation between the front-to-rear width of the narrow communication portions 55C and that of the remaining wide communication portions 55D.

Figure 8:
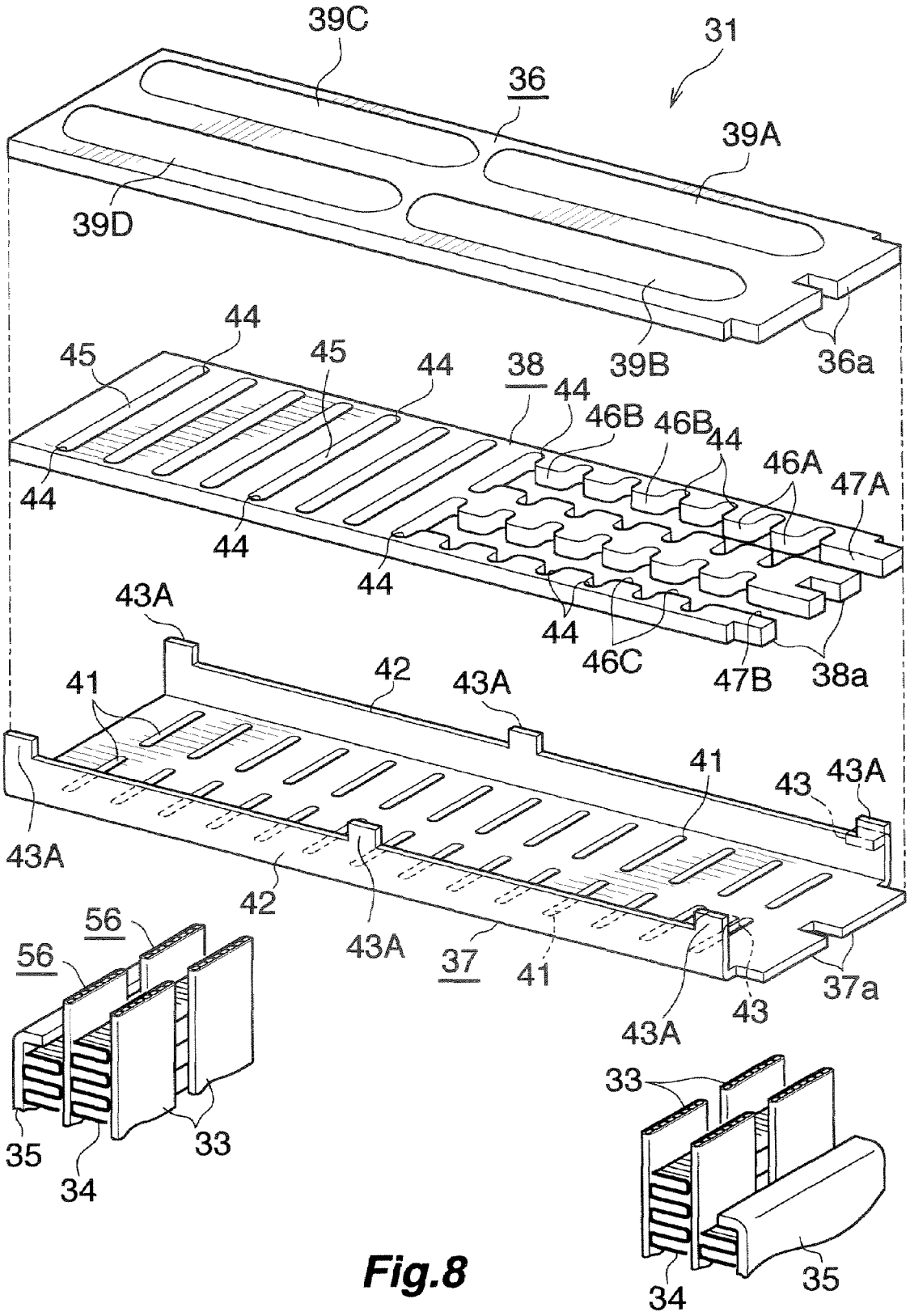
FIG. 8 is an exploded perspective view showing the first header tank of the evaporator of FIG. 1.
Figure 9:
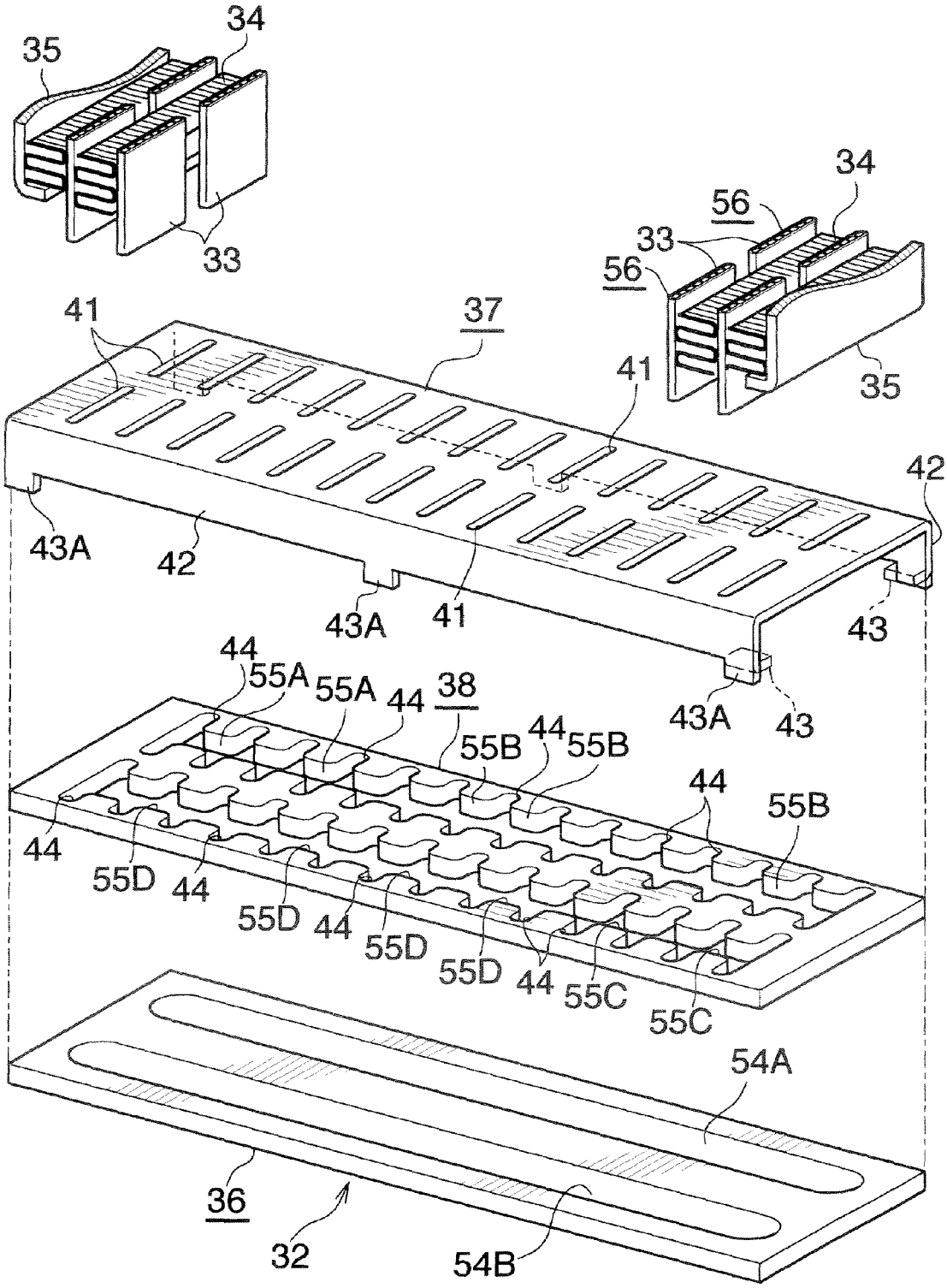
FIG. 9 is an exploded perspective view showing the second header tank of the evaporator of FIG. 1.
Figure 10:
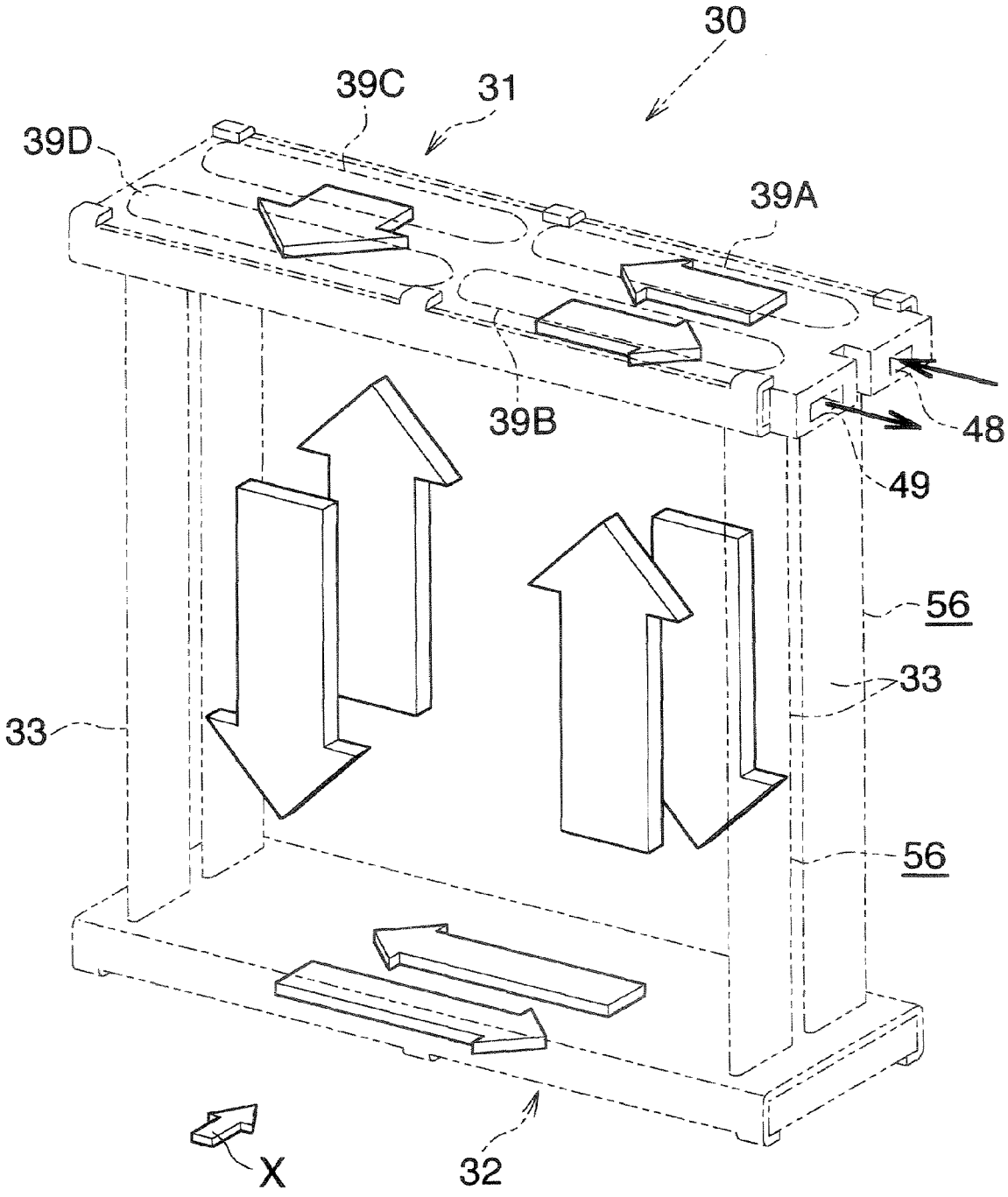
FIG. 10 is a view showing the flow of refrigerant in the evaporator of FIG. 1.

The header tanks 31 and 32 are manufactured as shown in FIGS. 8 and 9.

First, an aluminum brazing sheet having a brazing material on each of opposite sides thereof is subjected to press work, thereby forming the outside plate 36 of the first header tank 31, which plate has the outward bulging portions 39A, 39B, 39C, and 39D, and forming the outside plate 36 of the second header tank 32, which plate has the outward bulging portions 54A and 54B. Also, an aluminum brazing sheet having a brazing material on each of opposite sides thereof is subjected to press work, thereby forming the inside plates 37 of the first and second header tanks 31 and 32, each of which has the tube insertion holes 41, the covering walls 42, and engagement-portion-forming lugs 43A extending straight from the covering walls 42. Further, a bare aluminum material is subjected to press work, thereby forming the intermediate plate 38 of the first header tank 31, which plate has the communication holes 44 and the communication portions 45, and 46A to 46C, and forming the intermediate plate 38 of the second header tank 32, which plate has the communication holes 44 and the communication portions 55A to 55D. The outside plate 36, the intermediate plate 38, and the inside plate 37 of the first header tank 31 are formed to have respective rightward projecting portions 36*a*, 37*a*, and 38*a*. The intermediate plate 38 of the first header tank 31 is formed to have the cutout 47A and 47B.

Next, the three plates 36, 37, and 38 are stacked, and the engagement-portion-forming lugs 43A are bent to form the engagement portions 43, which engage with the outside plate 36, thereby forming a provisional assembly. Subsequently, the three plates 36, 37, and 38 are brazed together by use of the brazing material layers of the outside plate 36 and the inside plate 37, and the covering walls 42 are brazed to the front and rear side surfaces of the intermediate plate 38 and the outside plate 36. Further, the engagement portions 43 are brazed to the outside plate 36. In this manner, the two header tanks 31 and 32 are manufactured.

The heat exchange tube 33 is made from a bare metal material; in the present embodiment, an aluminum extrudate, and is in the form of a flat tube having an elongated front-to-rear width. The heat exchange tube 33 has inside thereof a plurality of refrigerant channels 33*a* extending in a longitudinal direction thereof and arranged in parallel. The heat exchange tubes 33 are brazed to the inside plates 37 of the header tanks 31 and 32 using the brazing material layers of the inside plates 37, with their opposite ends inserted into the corresponding tube insertion holes 41 of the header tanks 31 and 32. Opposite ends of the heat exchange tubes 33 are inserted into the corresponding communication holes 44 of the intermediate plates 38 to a mid depth thereof and are positioned within the corresponding refrigerant passages 1 to 4 (see FIG. 3). Between the header tanks 31 and 32, a plurality of; in the present embodiment, two, heat exchange tube groups 56 are arranged in rows spaced apart in the front-rear direction. Each heat exchange tube group 56 consists of a plurality of heat exchange tubes 33 arranged in parallel and spaced apart from one another in the left-right direction. The heat exchange tubes 33 positioned in the right half of the front heat exchange tube group 56 are connected, at their upper and lower ends, to the corresponding header tanks 31 and 32 so as to communicate with the interior of the first outward bulging portion 39A and the interior of the front outward bulging portion 54A. The heat exchange tubes 33 positioned in the left half of the front heat exchange tube group 56 are connected, at their upper and lower ends, to the corresponding header tanks 31 and 32 so as to communicate with the interior of the third outward bulging portion 39C and the interior of the front outward bulging portion 54A. The heat exchange tubes 33 positioned in the right half of the rear heat exchange tube group 56 are connected, at their upper and lower ends, to the corresponding header tanks 31 and 32 so as to communicate with the interior of the second outward bulging portion 39B and the interior of the rear outward bulging portion 54B. The heat exchange tubes 33 positioned in the left half of the rear heat exchange tube group 56 are connected, at their upper and lower ends, to the corresponding header tanks 31 and 32 so as to communicate with the interior of the fourth outward bulging portion 39D and the interior of the rear outward bulging portion 54B.

Instead of using an aluminum extrudate, the heat exchange tube 33 may be formed through rolling of an aluminum brazing sheet having a brazing material layer on each of opposite sides thereof. That is, a plate having two flat-wall forming portions connected via a connection portion is first formed. The plate has side-wall forming portions projecting from side edges of the flat-wall forming portions opposite the connection portion. A plurality of partition-wall forming portions project from the flat-wall forming portions at predetermined intervals in the width direction of the flat-wall forming portions. The thus-formed plate is bent at the connection portion in the form of a hairpin such that the side-wall forming portions come into mutual engagement, and the side-wall forming portions are brazed together, whereby partition walls are formed by the partition-wall forming portions.

The corrugate fin 34 is made in a wavy form from an aluminum brazing sheet having a brazing material layer on each of opposite sides thereof. Connecting portions interconnecting crest portions and trough portions of the corrugate fin 34 are provided with a plurality of louvers arranged in parallel in the front-rear direction. The corrugate fin 34 is used in common between the front and rear heat exchange tube groups 56 and has a front-to-rear width which is approximately equal to the distance from the front end of the heat exchange tube 33 of the front heat exchange tube group 56 to the rear end of the corresponding heat exchange tube 33 of the rear heat exchange tube group 56. Instead of using one corrugate fin 34 in common between the front and rear heat exchange tube groups 56, a corrugate fin may be provided between the adjacent heat exchange tubes 33 in each of the heat exchange tube groups 56.

The evaporator (30) is manufactured through the steps of:

preparing the above-described two provisional assemblies for manufacture of the header tanks 31 and 32, the plurality of heat exchange tubes 33, and the plurality of corrugate fins 34;

disposing the two provisional assemblies with a distance therebetween such that their inside plates 37 face each other;

alternately disposing the plurality of heat exchange tubes 33 and the plurality of corrugate fins 34;

inserting the opposite end portions of the heat exchange tubes 33 into the tube insertion holes 41 of the inside plates 37 of the two provisional assemblies;

disposing the side plates 35 on the outside of the corrugate fins 34 at the opposite ends;

fitting the refrigerant inlet-outlet member 51 to the provisional assembly of the three plates 36, 37, and 38 via the brazing sheet 57; and brazing the three plates 36, 37, and 38 of each provisional assembly together to form the header tanks 31 and 32, while brazing the heat exchange tubes 33 to the header tanks 31 and 32, the fins 34 to the heat exchange tubes 33, the side plates 35 to the fins 34, and the inlet-outlet member 51 to the first header tank 31.

The evaporator 30, together with a compressor, a gas cooler, a pressure-reducing device, and an intermediate heat exchanger for performing heat exchange between refrigerant from the gas cooler and refrigerant from the evaporator, constitutes a supercritical refrigeration cycle. The supercritical refrigeration cycle is installed in a vehicle; for example, an automobile, as a car air conditioner.

As shown in FIG. 10, with the evaporator 30 described above, $CO_2$ having passed through a pressure-reducing device (expansion valve) and having undergone pressure reduction therein flows through the refrigerant inflow channel 52 of the inlet-outlet member 51, and flows through the refrigerant inlet 48 into the first outward bulging portion 39A via the first refrigerant passage 1 of the first header tank 31. The refrigerant then flows leftward in the first refrigerant passage 1 and the first outward bulging portion 39A, and dividedly flows into the refrigerant channels 33*a* of all the heat exchange tubes 33 communicating with the interior of the first outward bulging portion 39A.

At this time, $CO_2$ in the liquid phase tends to flow into the refrigerant channels 33*a* of the heat exchange tube 33 on the side toward the refrigerant inlet 48 because of gravitational force. However, a large amount of $CO_2$ flows leftward in the first refrigerant passage 1 and the first outward bulging portion 39A because of the above-described structure in which, of all the communication portions 46A and 46B, which form the first refrigerant passage 1, the plurality of communication portions 46A on the upstream side with respect to the flow direction of refrigerant; i.e., on the right end side of the first refrigerant passage 1 has the width WA, as measured in the front-rear direction, smaller than the width WB of the remaining communication portions 46B. In addition, the number A of the narrow communication portions 46A and the total number B of the communication holes 44, which form the first refrigerant passage 1 (the total number of the heat exchange tubes 33 communicating with the first outward bulging portion 39A) satisfy the above-described relation, and the width WA of the narrow communication portions 46A and the width WB of the wide communication portions 46B satisfy the above-described relation. Therefore, the flow rates of $CO_2$ flowing though the refrigerant channels 33*a* of all the heat exchange tubes 33 communicating with the interior of the first outward bulging portion 39A are made uniform in accordance with the number of the heat exchange tubes 33 communicating with the interior of the first outward bulging portion 39A.

$CO_2$ having entered the refrigerant channels 33*a* of all the heat exchange tubes 33 communicating with the interior of the first outward bulging portion 39A flows down the refrigerant channels 33*a* and enters the front outward bulging portion 54A of the second header tank 32. $CO_2$ in the front outward bulging portion 54A flows leftward through the front outward bulging portion 54A and the front refrigerant passage 3 of the intermediate plate 38, and dividedly flows into the refrigerant channels 33*a* of all the heat exchange tubes 33 communicating with the interior of the third outward bulging portion 39C.

At this time, since the flow rates of $CO_2$ flowing though the refrigerant channels 33*a* of all the heat exchange tubes 33 communicating with the interior of the first outward bulging portion 39A are made uniform, the amount of $CO_2$ is uniform in a right-hand portion of the front refrigerant passage 3 and a right-hand portion of the front outward bulging portion 54A. However, in a left-hand portion of the front refrigerant passage 3 and a left-hand portion of the front outward bulging portion 54A, $CO_2$ becomes likely to flow leftward due to inertia. Therefore, $CO_2$ becomes likely to flow into the refrigerant channels 33*a* of the heat exchange tubes 33 close to the left end among all the heat exchange tubes 33 communicating with the interior of the third outward bulging portion 39C. However, of all the communication portions 55A and 55B, which form the front refrigerant passage 3, the plurality of communication portions 55A on the downstream side with respect to the flow direction of refrigerant; i.e., on the left end side of the front refrigerant passage 3 has the width WC, as measured in the front-rear direction, smaller than the width WD of the remaining communication portions 55B. Therefore, resistance is imparted to the flow of $CO_2$. In addition, the number C of the narrow communication portions 55A and the total number D of the communication holes 44, which form the front refrigerant passage 3 (the total number of the heat exchange tubes 33 communicating with the front outward bulging portion 54A) satisfy the above-described relation, and the width WC of the narrow communication portions 55A and the width WD of the wide communication portions 55B satisfy the above-described relation. Therefore, the flow rates of $CO_2$ flowing though the refrigerant channels 33*a* of all the heat exchange tubes 33 communicating with the interior of the front outward bulging portion 45A; i.e., with the interior of the third outward bulging portion 39C, are made uniform in accordance with the number of the heat exchange tubes 33 communicating with the interior of the front outward bulging portion 45A.

$CO_2$ having flowed into the refrigerant channels 33*a* of all the heat exchange tubes 33 communicating with the interior of the third outward bulging portion 39C changes its course to flow upward through the refrigerant channels 33*a*, and enters the third outward bulging portion 39C of the first header tank 31. $CO_2$ in the third outward bulging portion 39C flows through the refrigerant-turning communication portions 45 of the intermediate plate 38 of the first header tank 31 into the fourth outward bulging portion 39D; dividedly flows into the refrigerant channels 33*a* of all the heat exchange tubes 33 communicating with the fourth outward bulging portion 39D; changes its course to flow down the refrigerant channels 33*a*; and enters the rear outward bulging portion 54B of the second header tank 32. $CO_2$ in the rear outward bulging portion 54B flows rightward through the rear outward bulging portion 54B and the rear refrigerant passage 4, and dividedly flows into the channels 33*a* of all the heat exchange tubes 33 communicating with the second outward bulging portion 39B.

At this time, since the flow rates of $CO_2$ flowing though the refrigerant channels 33*a* of all the heat exchange tubes 33 communicating with the interior of the fourth outward bulging portion 39D are made uniform, the amount of $CO_2$ is uniform in a left-hand portion of the rear refrigerant passage 4 and a left-hand portion of the rear outward bulging portion 54B. However, in a right-hand portion of the rear refrigerant passage 4 and a right-hand portion of the rear outward bulging portion 54B, $CO_2$ becomes likely to flow rightward due to inertia. Therefore, $CO_2$ becomes likely to flow into the refrigerant channels 33*a* of the heat exchange tubes 33 close to the right end among all the heat exchange tubes 33 communicating with the interior of the second outward bulging portion 39B. However, of all the communication portions 55C and 55D, which form the rear refrigerant passage 4, the plurality of communication portions 55C on the downstream side with respect to the flow direction of refrigerant; i.e., on the right end side of the rear refrigerant passage 4 have a width, as measured in the front-rear direction, smaller than the width of the remaining communication portions 55D. Therefore, resistance is imparted to the flow of $CO_2$. In addition, the number of the narrow communication portions 55C and the total number of the communication holes 44, which form the rear refrigerant passage 4 (the total number of the heat exchange tubes 33 communicating with the rear outward bulging portion 54B) satisfy the above-described relation, and the width of the narrow communication portions 55C and the width of the wide communication portions 55D satisfy the above-described relation. Therefore, the divided flows of $CO_2$ to all the heat exchange tubes 33 communicating with the interior of the rear outward bulging portion 45B; i.e., with the interior of the second outward bulging portion 39B, are made uniform in accordance with the number of the heat exchange tubes 33 communicating with the interior of the rear outward bulging portion 45B.

$CO_2$ having flowed into all the heat exchange tubes 33 communicating with the second outward bulging portion 39B changes its course to flow up the channels 33*a*, and enters the second outward bulging portion 39B of the first header tank 31. Subsequently, $CO_2$ flows out of the second outward bulging portion 39B via the second refrigerant passage 2, the refrigerant outlet 49, and the refrigerant outflow channel 53 of the inlet-outlet member 51. While flowing through the refrigerant channels 33*a* of the heat exchange tubes 33, $CO_2$ is subjected to heat exchange with air flowing through the air-passing clearances in the direction of arrow X shown in FIGS. 1 and 10 and flows out from the evaporator 30 in a vapor phase.

In the above embodiment, the heat exchanger according to the present invention is applied to an evaporator for use in a supercritical refrigeration cycle. However, the present invention is not limited thereto. The heat exchanger according to the present invention may be applied to a gas cooler for use in a supercritical refrigeration cycle.

In the above embodiment, $CO_2$ is used as a supercritical refrigerant for a supercritical refrigeration cycle. However, the present invention is not limited thereto. Ethylene, ethane, nitrogen oxide, or the like may be used.

Next, text examples performed by use of the evaporator according to the above-described embodiment will be described.

TEST EXAMPLE 1

An evaporator 30 used in the test was configured such that the evaporator has a height of 250 mm and a width of 250 mm as measured in the left-right direction, the number of the heat exchange tubes 33 is 48, and the total number B of the heat exchange tubes 33 communicating with the first outward bulging portion 39A of the first header tank 31 is 12. The cooling capacity of the evaporator was obtained under the conditions that the degree of superheat of refrigerant at the exit was 0 degree, while the ratio (A/B) of the number A of the narrow communication portions 46A of the first refrigerant passage 1 to the total number B of the heat exchange tubes 33 communicating with the first outward bulging portion 39A of the first header tank 31 was changed by changing the number A of the narrow communication portions 46A.

Figure 11:
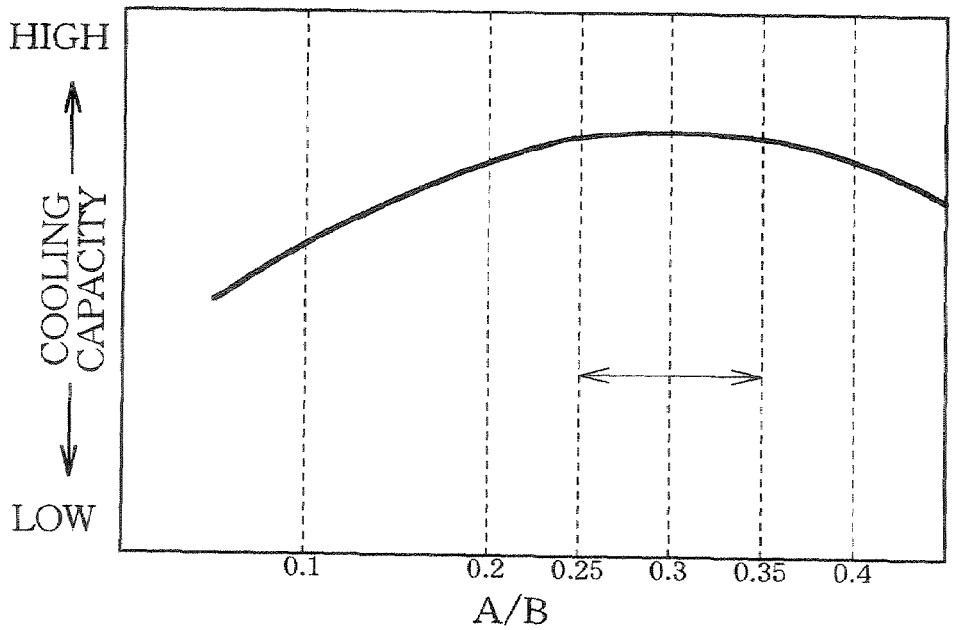
FIG. 11 is a graph showing the results of Text Example 1.

FIG. 11 shows the relation between the ratio (A/B) and the cooling capacity. The results shown in FIG. 11 demonstrate that the evaporator has an excellent cooling capacity when the ratio (A/B) falls within the range of 0.25 to 0.35.

TEST EXAMPLE 2

An evaporator 30 used in the test was configured such that the evaporator has a height of 250 mm and a width of 250 mm as measured in the left-right direction, the number of the heat exchange tubes 33 is 48, the total number B of the heat exchange tubes 33 communicating with the first outward bulging portion 39A of the first header tank 31 is 12, and the width WB of the wide communication portions 46B of the first refrigerant passage 1 is 7 mm. The cooling capacity and passage resistance of the evaporator were obtained under the conditions that the degree of superheat of refrigerant at the exit was 0 degree, while the ratio (WA/WB) of the width WA of the narrow communication portions 46A of the first refrigerant passage 1 to the width WB of the wide communication portions 46B of the first refrigerant passage 1 communicating with the first outward bulging portion 39A of the first header tank 31 was changed by changing the width WA of the narrow communication portions 46A.

Figure 12:
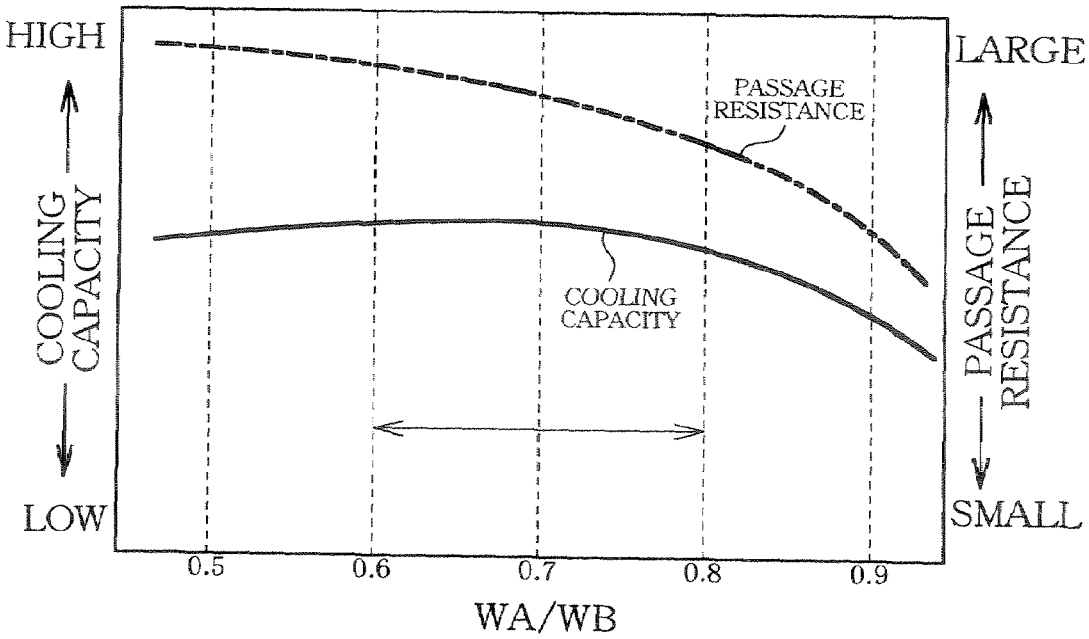
FIG. 12 is a graph showing the results of Text Example 2.

FIG. 12 shows the relation between the ratio (WA/WB) and the cooling capacity and the passage resistance. The results shown in FIG. 12 demonstrate that the evaporator has an excellent cooling capacity, while suppressing an increase in the passage resistance, when the ratio (WA/WB) falls within the range of 0.6 to 0.8.

TEST EXAMPLE 3

The same evaporator as in Test Example 1 was used. The cooling capacity of the evaporator was obtained under the same conditions as in Test Example 1, while the ratio (C/D) of the number C of the narrow communication portions 55A and 55C of the front and rear refrigerant passages 3 and 4 to the total number D of the heat exchange tubes 33 communicating with the front and rear outward bulging portions 54A and 54B of the second header tank 32 was changed. Although not illustrated, the test results show that the relation between the ratio (C/D) and the cooling capacity is similar to that shown in FIG. 11.

TEST EXAMPLE 4

The same evaporator as in Test Example 2 was used. The cooling capacity and the passage resistance of the evaporator was obtained under the same conditions as in Test Example 2, while the ratio (WC/WD) of the width WC of the narrow communication portions 55A and 55C to the width WD of the wide communication portions 55B and 55D of the front and rear refrigerant passages 3 and 4 communicating with the front and rear outward bulging portions 54A and 54B of the second header tank 32 was changed. Although not illustrated, the test results show that the relation between the ratio (WC/WD) and the cooling capacity and the passage resistance is similar to that shown in FIG. 12.

What is claimed is:

1. A heat exchanger comprising upper and lower header tanks disposed apart from each other, and a plurality of heat exchange tubes disposed in parallel between the two header tanks and having opposite end portions connected to the respective header tanks, wherein each of the head tanks is configured such that an outside plate, an inside plate, and an intermediate plate intervening between the outside and inside plates are brazed together in layers; each of the outside plates of the upper and lower header tanks has a plurality of outwardly bulging portions each extending in the left-right direction and having an opening closed by the intermediate plate; the inside plate has a plurality of tube insertion holes in the form of through-holes formed in a region corresponding to the outwardly bulging portions of the outside plate and spaced apart from one another along the left-right direction; the intermediate plate has a plurality of communication holes in the form of through-holes so as to allow the respective tube insertion holes of the inside plate to communicate with the interiors of the corresponding outwardly bulging portions of the outside plate; opposite end portions of the heat exchange tubes are inserted through the respective tube insertion holes of the inside plates of the two header tanks and are brazed to the inside plates; at least one outwardly bulging portion of each of the upper and lower header tanks serves a refrigerant-passage outwardly bulging portion within which refrigerant flows in the longitudinal direction; the refrigerant-passage outwardly bulging portion of the upper header tank serves as an inflow-side refrigerant-passage outwardly bulging portion whose one end portion communicates with a refrigerant inlet formed in the upper header tank; the communication holes of the intermediate plates communicating with the refrigerant-passage outwardly bulging portions of the upper and lower header tanks are connected by means of communication portions each formed between adjacent communication holes of the intermediate plates; and the communication holes communicating with the refrigerant-passage outwardly bulging portions and the communication portions connecting these communication holes cooperate to form refrigerant passages in the intermediate plates of the upper and lower header tanks, the passages communicating with the interiors of the corresponding refrigerant-passage outwardly bulging portions and causing the refrigerant to flow in the left-right direction, wherein of all the communication portions which form the refrigerant passage of the intermediate plate communicating with the inflow-side refrigerant-passage outwardly bulging portion of the upper header tank, a plurality of narrow communication portions on the upstream side with respect to the flow direction of the refrigerant have a width, as measured in the front-rear direction, smaller than that of the remaining communication portions; and the relation $0.25 \leqq A/B \leqq 0.35$ is satisfied, where A represents the number of the narrow communication portions, and B represents the total number of the communication holes which form the refrigerant passage and wherein the relation $0.6 \leqq WA/WB \leqq 0.8$ is satisfied, where WA represents the width, as measured in the front-rear direction, of the narrow communication portions of all the communication portions which form the refrigerant passage of the intermediate plate communicating with the inflow-side refrigerant-passage outwardly bulging portion of the upper header tank, and WB represents the width of the remaining wide communication portions, as measured in the front-rear direction.

2. A heat exchanger according to claim 1, wherein the width WB of the wide communication portions falls within the range of 5 to 9 mm.

3. A heat exchanger comprising upper and lower header tanks disposed apart from each other, and a plurality of heat exchange tubes disposed in parallel between the two header tanks and having opposite end portions connected to the respective header tanks, wherein each of the head tanks is configured such that an outside plate, an inside plate, and an intermediate plate intervening between the outside and inside plates are brazed together in layers; each of the outside plates of the upper and lower header tanks has a plurality of outwardly bulging portions each extending in the left-right direction and having an opening closed by the intermediate plate; the inside plate has a plurality of tube insertion holes in the form of through-holes formed in a region corresponding to the outwardly bulging portions of the outside plate and spaced apart from one another along the left-right direction; the intermediate plate has a plurality of communication holes in the form of through-holes so as to allow the respective tube insertion holes of the inside plate to communicate with the interiors of the corresponding outwardly bulging portions of the outside plate; opposite end portions of the heat exchange tubes are inserted through the respective tube insertion holes of the inside plates of the two header tanks and are brazed to the inside plates; at least one outwardly bulging portion of each of the upper and lower header tanks serves a refrigerant-passage outwardly bulging portion within which refrigerant flows in the longitudinal direction; the refrigerant-passage outwardly bulging portion of the upper header tank serves as an inflow-side refrigerant-passage outwardly bulging portion whose one end portion communicates with a refrigerant inlet formed in the upper header tank; the communication holes of the intermediate plates communicating with the refrigerant-passage outwardly bulging portions of the upper and lower header tanks are connected by means of communication portions each formed between adjacent communication holes of the intermediate plates; and the communication holes communicating with the refrigerant-passage outwardly bulging portions and the communication portions connecting these communication holes cooperate to form refrigerant passages in the intermediate plates of the upper and lower header tanks, the passages communicating with the interiors of the corresponding refrigerant-passage outwardly bulging portions and causing the refrigerant to flow in the left-right direction, wherein of all the communication portions which form the refrigerant passage of the intermediate plate communicating with the refrigerant-passage outwardly bulging portion of the lower header tank, a plurality of narrow communication portions on the downstream side with respect to the flow direction of the refrigerant have a width, as measured in the front-rear direction, smaller than that of the remaining communication portions; and the relation $0.25 \leqq C/D \leqq 0.35$ is satisfied, where C represents the number of the narrow communication portions, and D represents the total number of the communication holes which form the refrigerant passage and wherein the relation $0.6 \leqq WC/WD \leqq 0.8$ is satisfied, where WC represents the width, as measured in the front-rear direction, of the narrow communication portions of all the communication portions which form the refrigerant passage of the intermediate plate communicating with the refrigerant-passage outwardly bulging portion of the lower header tank, and WD represents the width of the remaining wide communication portions, as measured in the front-rear direction.

4. A heat exchanger according to claim 3, wherein the width WD of the wide communication portions falls within the range of 5 to 9 mm.

5. A heat exchanger according to claim 1 or 3, wherein the outside plate of the upper header tank has four outward bulging portions arranged apart from one another in the front-rear and left-right directions, and the outside plate of the lower header tank has two outward bulging portions arranged apart from each other in the front-rear direction such that each outward bulging portion faces corresponding two outward bulging portions of the upper header tank which are located adjacent to each other in the left-right direction;

a plurality of tube insertion holes are formed in each of front and rear portions of the inside plates of the two header tanks, and a plurality of communication holes are formed in each of front and rear portions of the intermediate plates of the two header tanks;

two pairs each including front and rear outwardly bulging portions are arranged on the upper header tank in the left-right direction, wherein the outwardly bulging portions of one of the pairs serve as the refrigerant-passage outwardly bulging portions, one of the two refrigerant-passage outwardly bulging portions serves as the inflow-side refrigerant-passage outwardly bulging portion, the other refrigerant-passage outwardly bulging portion serves as an outflow-side refrigerant-passage outwardly bulging portion whose one end communicates with a refrigerant outlet formed in the upper header tank, and the communication holes of the intermediate plate communicating with one of the two outwardly bulging portions of the other pair are connected to the communication holes of the intermediate plate communicating with the other outwardly bulging portion of the other pair by refrigerant-turning communication portions formed in the intermediate plate, whereby communication is established between the two outwardly bulging portions of the other pair; and the two outwardly bulging portions of the lower header tank each serves as a refrigerant-passage outwardly bulging portion.

* * * * *